US010921733B1

(12) United States Patent
Tamazawa et al.

(10) Patent No.: US 10,921,733 B1
(45) Date of Patent: Feb. 16, 2021

(54) DEVELOPING DEVICE AND IMAGE FORMING APPARATUS HAVING DEVELOPER REPLENISHING BLADE

(71) Applicant: FUJI XEROX CO., LTD., Tokyo (JP)

(72) Inventors: Norihiro Tamazawa, Kanagawa (JP); Yoshifumi Ozaki, Kanagawa (JP); Shinichi Kuramoto, Kanagawa (JP); Yoshitaka Nakajima, Kanagawa (JP); Tomoyuki Yoshii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/774,178

(22) Filed: Jan. 28, 2020

(30) Foreign Application Priority Data

Sep. 12, 2019 (JP) ..... 2019-166541

(51) Int. Cl.
*G03G 15/08* (2006.01)

(52) U.S. Cl.
CPC ..... *G03G 15/0893* (2013.01); *G03G 15/0808* (2013.01); *G03G 15/0889* (2013.01)

(58) Field of Classification Search
CPC ..... G03G 15/0891; G03G 15/0893
See application file for complete search history.

(56) References Cited

U.S. PATENT DOCUMENTS

| | | | | |
|---|---|---|---|---|
| 9,229,373 | B1 * | 1/2016 | Gyotoku | G03G 15/0891 |
| 9,348,263 | B2 | 5/2016 | Iketani et al. | |
| 2006/0222412 | A1 * | 10/2006 | Ito | G03G 15/0875 399/258 |
| 2013/0078002 | A1 * | 3/2013 | Stelter | G03G 15/0893 399/254 |

FOREIGN PATENT DOCUMENTS

JP 2016-024255 A 2/2016

* cited by examiner

*Primary Examiner* — Walter L Lindsay, Jr.
*Assistant Examiner* — Arlene Heredia
(74) *Attorney, Agent, or Firm* — Sughrue Mion, PLLC

(57) ABSTRACT

A developing device includes: a housing having a first transport path through which developer is supplied, a second transport path adjoining the first transport path with a first partition wall therebetween, and a first communication path communicating with the second transport path on a downstream side in a developer transport direction in the first transport path; a first transport member disposed in the first transport path and having an axially rotatable first rotary shaft and a first spiral blade projecting from an outer circumferential surface of the first rotary shaft; a second transport member disposed in the second transport path and having an axially rotatable second rotary shaft and a second spiral blade projecting from an outer circumferential surface of the second rotary shaft; and a first blade member projecting from the outer circumferential surface of the first rotary shaft, at a position facing the first communication path, the blade member discharging the developer onto the second transport path from above the first rotary shaft in the first transport path with the rotation of the first rotary shaft.

13 Claims, 6 Drawing Sheets

DEVELOPING DEVICE AND IMAGE FORMING APPARATUS HAVING DEVELOPER REPLENISHING BLADE

CROSS-REFERENCE TO RELATED APPLICATIONS

This application is based on and claims priority under 35 USC 119 from Japanese Patent Application No. 2019-166541 filed Sep. 12, 2019.

BACKGROUND

(i) Technical Field

The present disclosure relates to a developing device and an image forming apparatus.

(ii) Related Art

Japanese Unexamined Patent Application Publication No. 2016-024255 discloses a developing device including: a developer container having multiple developer transport paths disposed substantially parallel to one another, and communicating portions provided at both ends of the developer transport paths, through which the developer is transferred; a developer carrier that carries the developer on the surface thereof and that is supported by the developer container so as to be rotatable; and stirring/transporting members disposed in the developer transport paths to transport, while stirring, the developer in the longitudinal direction. At least one stirring/transporting member has, at a portion facing the communicating portion located on the downstream side of the developer transport path in the developer transport direction, a projecting transport fin that transports the developer toward the communicating portion. The transport fin is inclined at a predetermined angle with respect to the direction of the rotation axis of the stirring/transporting member such that the direction in which the developer is transport by the transport fin is turned back at an acute angle with respect to the developer transport direction in the developer transport path.

SUMMARY

Aspects of non-limiting embodiments of the present disclosure relate to a stirring member disposed in a developing device to transport developer with a spiral blade, and the purpose thereof is to suppress compaction of the developer, compared with a configuration in which only a reverse spiral blade is provided so as to face a communication path through which the developer is supplied to an adjoining transport path.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a developing device including: a housing having a first transport path through which developer is supplied, a second transport path adjoining the first transport path with a first partition wall therebetween, and a first communication path communicating with the second transport path on a downstream side in a developer transport direction in the first transport path; a first transport member disposed in the first transport path and having an axially rotatable first rotary shaft and a first spiral blade projecting from an outer circumferential surface of the first rotary shaft; a second transport member disposed in the second transport path and having an axially rotatable second rotary shaft and a second spiral blade projecting from an outer circumferential surface of the second rotary shaft; and a first blade member projecting from the outer circumferential surface of the first rotary shaft, at a position facing the first communication path, the blade member discharging the developer onto the second transport path from above the first rotary shaft in the first transport path with the rotation of the first rotary shaft.

BRIEF DESCRIPTION OF THE DRAWINGS

Exemplary embodiment of the present disclosure will be described in detail based on the following figures, wherein.

DETAILED DESCRIPTION

Figure 1:
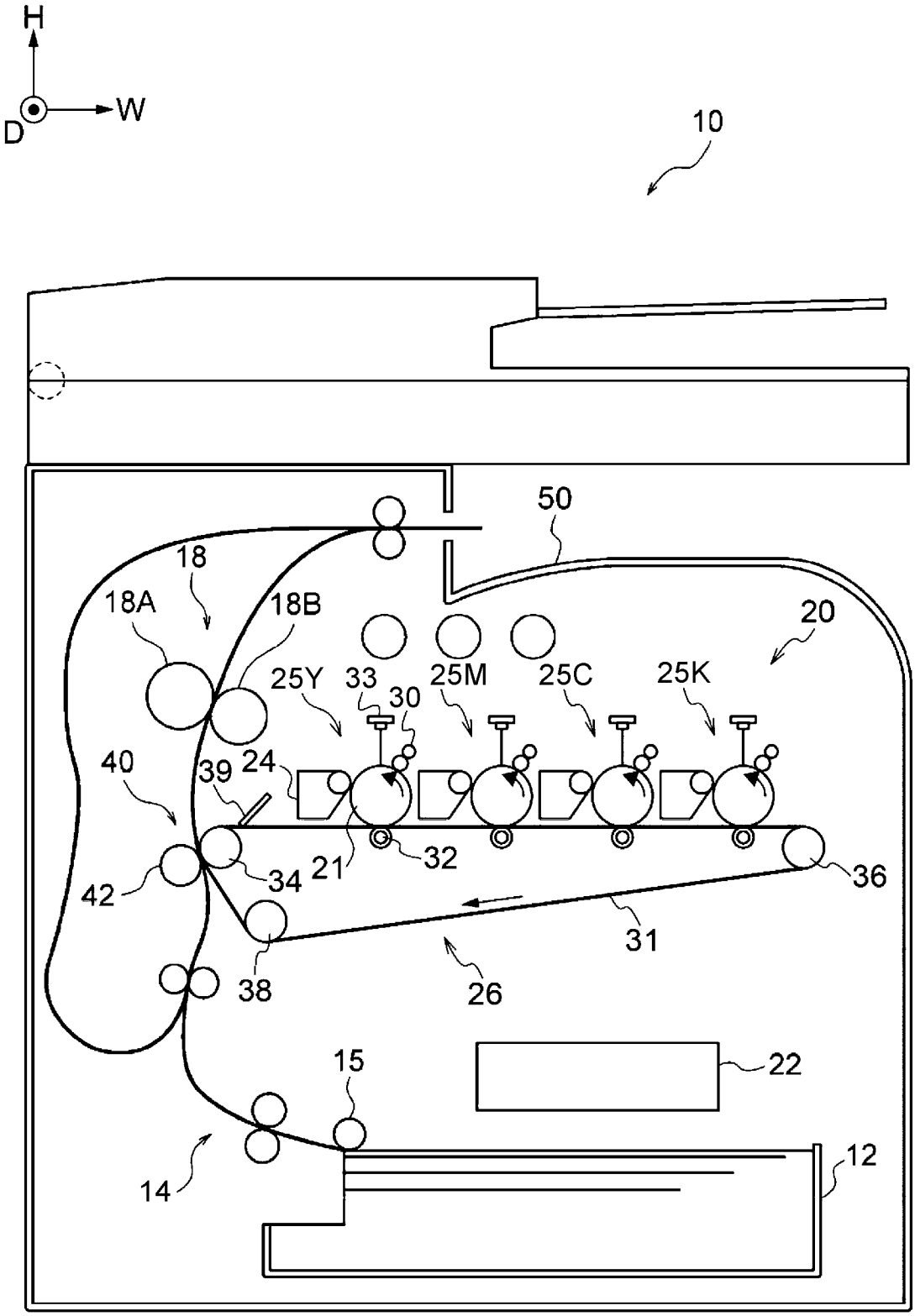
FIG. 1 illustrates a schematic configuration of an image forming apparatus including developing devices according to this exemplary embodiment.

An exemplary embodiment for implementing the present disclosure (hereinbelow, this exemplary embodiment) will be described below. In the description below, arrows H, W, and D in the drawings represent the top-bottom direction (vertical direction), the width direction (horizontal direction), and the depth direction (horizontal direction).

An example developing device and an example image forming apparatus according to this exemplary embodiment will be described with reference to FIGS. 1 to 6.

FIG. 1 illustrates an example configuration of an image forming apparatus including developing devices according to the exemplary embodiment of the present disclosure. As illustrated in FIG. 1, an image forming apparatus 10 includes: a sheet storage part 12 that stores sheets P, serving as an example of media; a transport unit 14, a toner-image forming section 20, a fixing device 18, an output part 50, and a controller 22. The toner-image forming section 20 includes four image forming units 25Y, 25M, 25C, and 25K, and a transfer unit 26. Yellow (Y), magenta (M), cyan (C), and black (K) are example toner colors. The image forming units 25Y, 25M, 25C, and 25K each include, at least, an image carrier 21, a charging device 30, an exposure device 33, and a developing device 24. In the image forming units 25Y, 25M, 25C, and 25K, yellow (Y), magenta (M), cyan (C), and black (K) toner images, respectively, are formed on the outer circumferential surfaces of the image carriers 21.

The image carriers 21 hold toner images developed by the developing devices 24. Each image carrier 21 has a cylindrical shape, has a photosensitive layer on the surface thereof, and is rotationally driven in the direction indicated by the arrow by a driving unit (not shown). The developing device 24 develops a latent image formed on the image carrier 21 into a toner image. The image carrier 21 is an example of an image carrier.

The transfer unit 26 includes a transfer belt 31, first transfer rollers 32 corresponding to the respective colors, a driving roller 34, and a second transfer roller 42. The orientation of the transfer belt 31 is determined by the four first transfer rollers 32, the driving roller 34, a support roller 36, and a tension roller 38, which are in contact with the inner circumferential surface of the transfer belt 31. A cleaning device 39 is provided on the transfer belt 31, on the downstream side of a second transfer part 40 at which the transfer belt 31 is in contact with the second transfer roller 42. The outer circumferential surfaces of the image carriers 21 in the image forming units 25Y, 25M, 25C, and 25K are in contact with the outer circumferential surface of the transfer belt 31. The second transfer part 40 is an example of a transfer part.

The transport unit 14 includes a feed roller 15 that feeds a sheet P from the sheet storage part 12, and multiple transport roller pairs (not shown) provided along the transport path. The transport unit 14 transports the sheet P fed by the feed roller 15 to the second transfer part 40, at which the driving roller 34 and the second transfer roller 42 are opposed to each other. The transport unit 14 further transports the sheet P to the fixing device 18. The fixing device 18 fixes, to the sheet P, the toner image that has been second-transferred to the image sheet P, and the sheet P is transported to the output part 50 by the transport unit 14.

In this image forming apparatus 10, exposure light emitted from the exposure devices 33 according to respective-color image data is incident on the outer circumferential surfaces of the image carriers 21 charged by the charging devices 30, forming latent images corresponding to the respective-color image data on the outer circumferential surfaces of the image carriers 21. The latent images formed on the outer circumferential surfaces of the image carriers 21 are developed into color toner images by the developing devices 24. The color toner images on the outer circumferential surfaces of the image carriers 21 are first-transferred to the outer circumferential surface of the transfer belt 31 by the first transfer rollers 32 opposed to the image carriers 21.

The sheet P is fed out from the sheet storage part 12 in accordance with the timing when the color toner images first-transferred to the transfer belt 31 reach the second transfer part 40 and is transported to the second transfer part 40 having the second transfer roller 42. At the second transfer part 40, the color toner images on the transfer belt 31 are second-transferred to the sheet P. The sheet P having the toner image transferred thereto is transported to the fixing device 18 and is heated at a contact portion where a pressure roller 18A and a heating roller 18B are in contact with each other. As a result, the toner image is fixed to the sheet P, and the sheet P is discharged onto the output part 50.

Configuration and Basic Operation of Developing Device

The developing devices 24 will be described in detail below. Because the developing devices 24 corresponding to the respective colors have the same structure, one developing device 24 will be described as an example below.

Relevant Part Configuration

Figure 6:
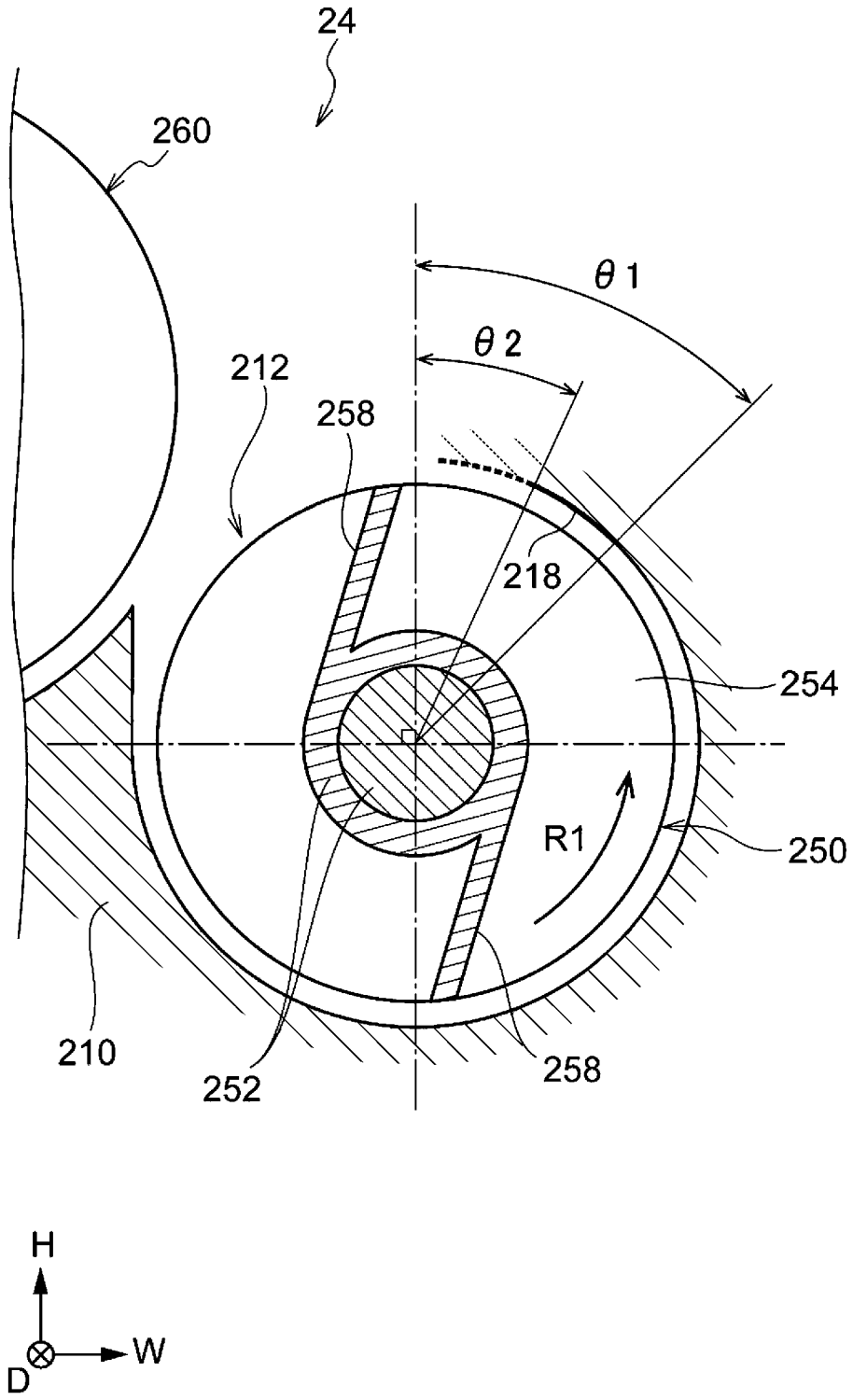
FIG. 6 is a sectional view illustrating a guide part in detail.

Next, referring to FIGS. 2 to 6, the developing device 24 will be described. Herein, the directions pointed by arrows G1, G2, and G3 in FIG. 2 will be described as the downstream side of the developer transport direction, and the directions opposite thereto will be described as the upstream side of the developer transport direction; that is, the arrows G1, G2, and G3 will be described so as to correspond to the upstream side/downstream side of transport paths (a replenish path, a supply path, and a stirring path described below) along which the developer G is transported. FIGS. 3, 4, and 6 show the developing device 24 as viewed from the side opposite to the side from which the developing device 24 is viewed in FIG. 1 in the depth direction.

Figure 2:
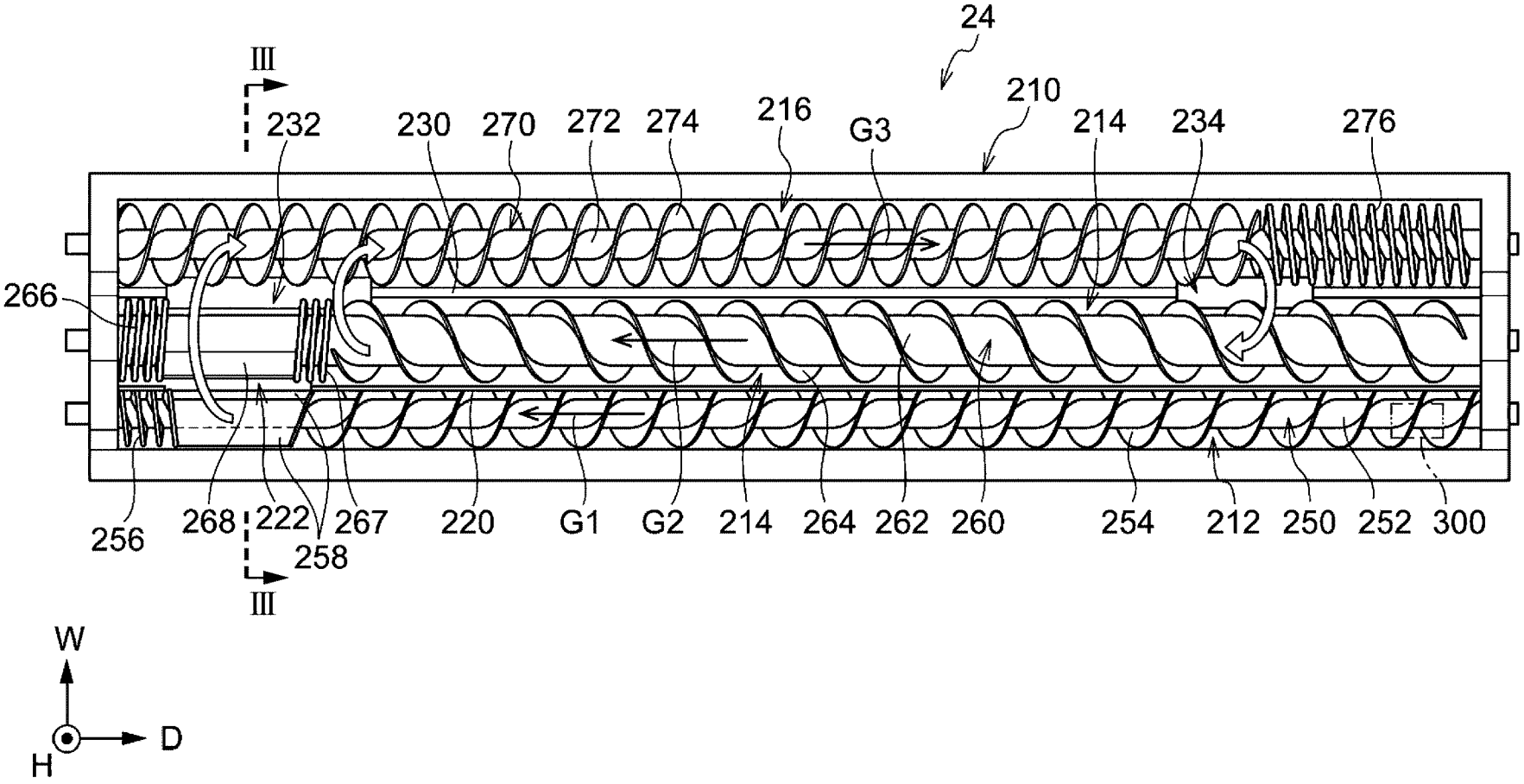
FIG. 2 is a horizontal sectional view of a developing device according to this exemplary embodiment.
Figure 3:
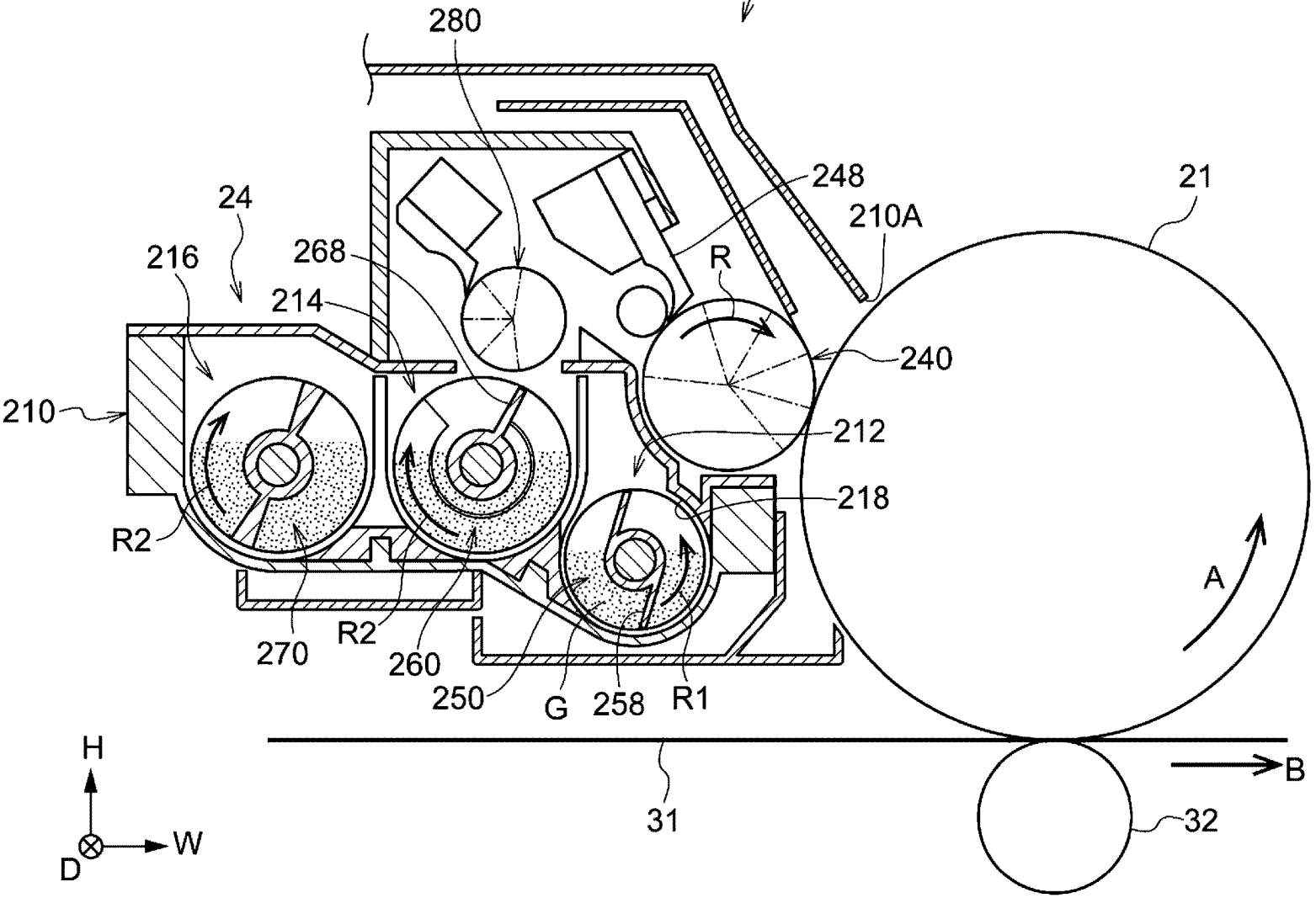
FIG. 3 is a sectional view taken along line III-III in FIG. 2, showing the developing device and components therearound.
Figure 4:
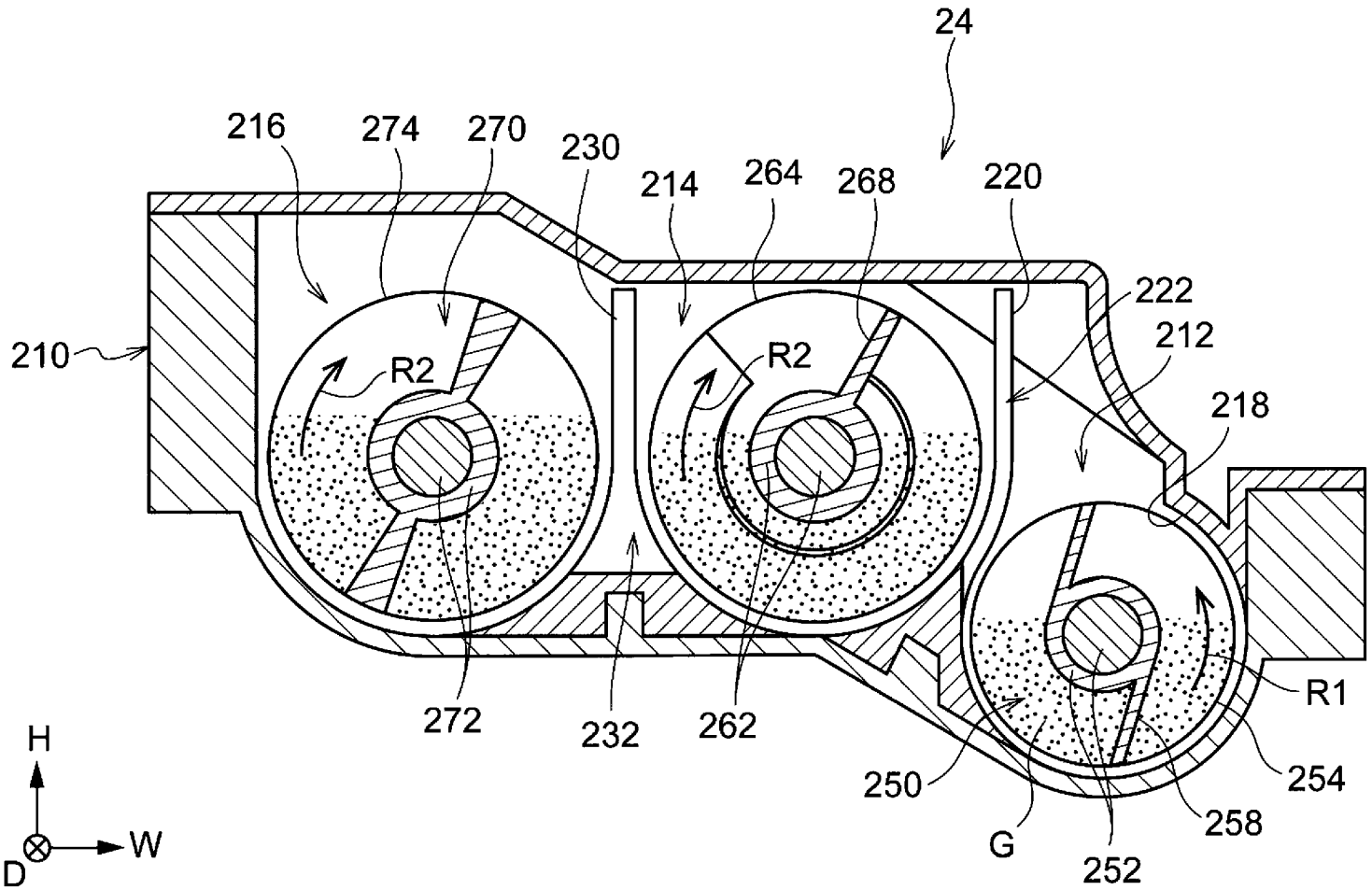
FIG. 4 is an enlarged sectional view of FIG. 3.
Figure 5:
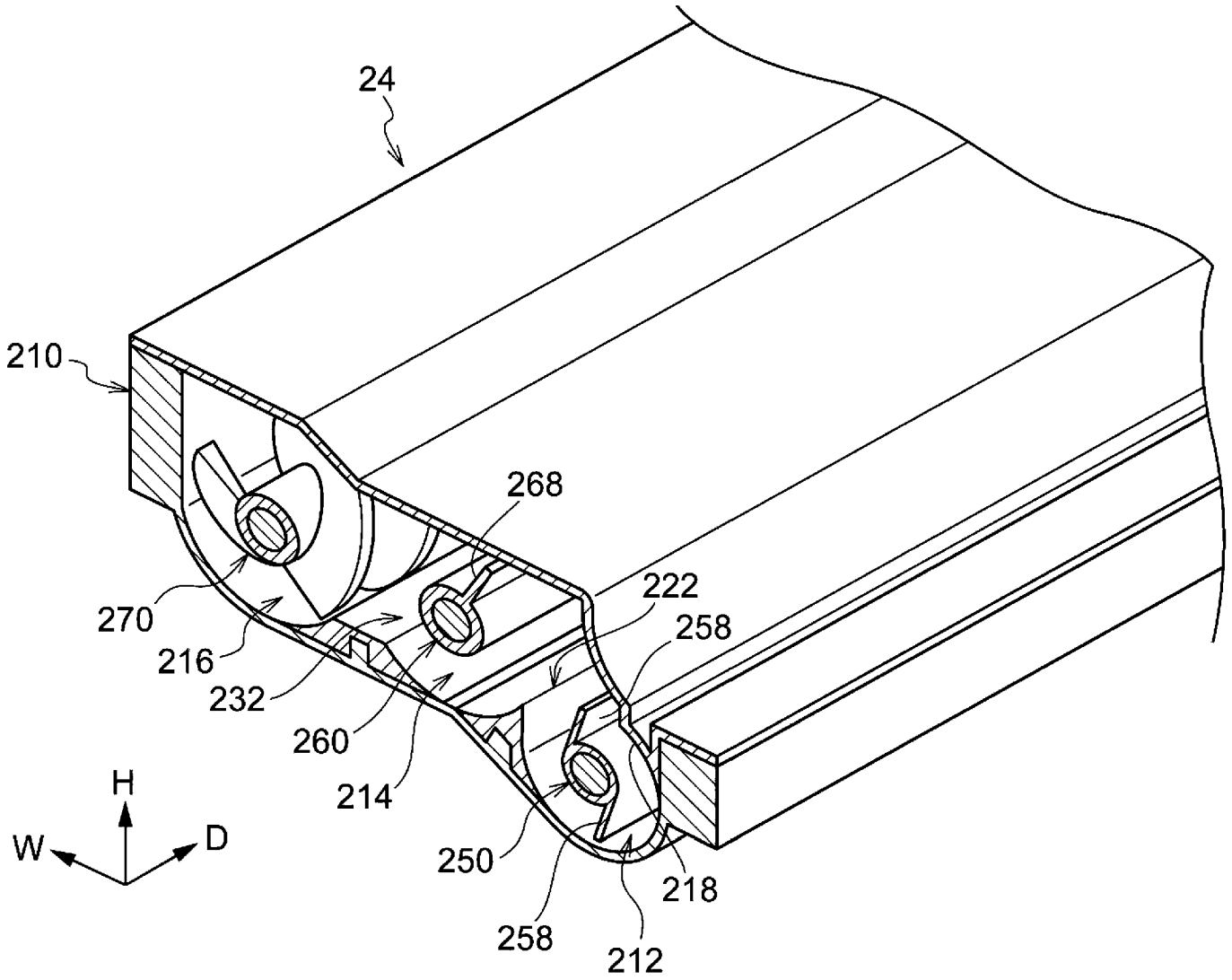
FIG. 5 is a partially cut away perspective view illustrating the arrangement of the first transport member, the second transport member, and the third transport member in FIG. 3.

As shown in FIGS. 2 and 3, in the developing device 24, a housing 210, serving as a developing device body, has a replenish path 212 (described below), a supply path 214 adjoining the replenish path 212, and a stirring path 216 adjoining the supply path 214, on the side opposite from the replenish path 212. The replenish path 212 accommodates a rotatable replenish auger 250, the supply path 214 accommodates a rotatable supply auger 260, and the stirring path 216 accommodates a rotatable stirring auger 270.

The housing 210 accommodates a scoop roller 280 disposed above the supply auger 260 in the height direction H, a developing roller 240 disposed between the scoop roller 280 and the image carrier 21, and a layer restricting member 248.

The developing roller 240 delivers the developer G to a latent image on the image carrier 21, at an opening 210A (described below) facing the image carrier 21. The housing 210 accommodates the developer G containing toner and carrier.

Housing

The housing 210 has, in the upper portion thereof, the opening 210A facing the image carrier 21. The developing roller 240, which delivers the developer G to the image carrier 21, is disposed in the housing 210 so as to be partially exposed from the opening 210A and so as to extend in the depth direction.

In the lower portion of the housing 210, below the developing roller 240, the replenish path 212 through which the developer G is supplied and transported to the developing device 24 is disposed. The housing 210 also has the supply path 214 adjoining the replenish path 212, on the side opposite from the developing roller 240, and the stirring path 216 adjoining the supply path 214, on the side opposite from the replenish path 212.

Replenish Path

As shown in FIGS. 2 to 4, the replenish path 212 is formed between the outer wall of the housing 210 extending in the depth direction D of the housing 210 and a first partition wall 220 (described below). In the replenish path 212, the replenish auger 250 (described below) rotatable about a rotary shaft 252 is provided. The replenish auger 250 transports the developer G in the arrow G1 direction. The developer G is supplied from a developer replenishing unit (not shown) provided on the upstream side in the developer transport direction G1, more specifically, on the outside of the position corresponding to the developing roller 240 (on the right side in FIG. 2). More specifically, the developer G is supplied to the replenish path 212 from the developer replenishing unit (not shown) through a developer replenish path 300 provided on the far side, in the depth direction D of the housing 210, of an area of the developing roller 240 over which the developer G is delivered.

Furthermore, a ceiling portion 218 (described below) is formed in the housing 210, at a portion around the replenish auger 250. Herein, the replenish path 212 is an example of a first transport path.

The replenish path 212 is formed below the supply path 214 (described below) in the height direction H. The detailed configuration of the replenish path 212 will be described below, together with the relationship between the replenish auger 250 and the supply auger 260.

Supply Path

The supply path 214 is formed between the first partition wall 220 and a second partition wall 230 (described below) extending in the depth direction D of the housing 210. In the supply path 214, the supply auger 260 (described below) rotatable about a rotary shaft 262 is provided. The supply auger 260 transports the developer G in the arrow G2 direction. Herein, the supply path 214 is an example of a second transport path.

Stirring Path

The stirring path 216 is formed between the second partition wall 230 and the outer wall of the housing 210 extending in the depth direction D of the housing 210 on the side opposite from the replenish path 212. In the stirring path 216, the stirring auger 270 (described below) rotatable about a rotary shaft 272 is provided. The stirring auger 270 transports the developer G in the arrow G3 direction. Herein, the stirring path 216 is an example of a third transport path.

First Partition Wall

The replenish path 212 and the supply path 214 are divided by the first partition wall 220, except for a first communication path 222 located on the downstream side of the replenish path 212 in the developer transport direction.

The first partition wall 220 extends from the upstream side (i.e., the right end in FIG. 2) to the downstream side (i.e., the left end in FIG. 2) in the direction in which the replenish auger 250 transports the developer in the depth direction D in FIG. 2 and is in contact with and fixed to the inner walls of the housing 210 at the ends thereof.

At the downstream end of the first partition wall 220 in the developer transport direction G1, the first communication path 222, serving as a developer supply port, communicating between the replenish path 212 and the supply path 214 is provided at a position corresponding to a portion of discharge plates 258 (described below) provided on the replenish auger 250 and a reverse spiral blade 256. Herein, the first communication path 222 is an example of a first communication path.

Second Partition Wall

The second partition wall 230 extends from the upstream side (i.e., the right end in FIG. 2) to the downstream side (i.e., the left end in FIG. 2) in the direction in which the replenish auger 250 transports the developer in the depth direction D in FIG. 2 and is in contact with and fixed to the inner walls of the housing 210. The second partition wall 230 has a second communication path 232, which is an opening communicating between the supply path 214 and the stirring path 216 on the upstream side of the developer transport direction G3 in the stirring path 216. In other words, the second communication path 232 faces a delivery plate 268, a reverse spiral blade 266, a blocking spiral blade 267, and a spiral blade 264, etc. of the supply auger 260, which will be described below.

A third communication path 234, which is an opening communicating between the stirring path 216 and the supply path 214, is formed in the second partition wall 230, on the downstream side (i.e., the right side in FIG. 2) in the developer transport direction G3. In other words, the third communication path 234 is formed so as to face a position straddling a spiral blade 274 and a reverse spiral blade 276 of the stirring auger 270 (described below). The developing roller 240 (not shown in FIG. 2) is disposed at a position corresponding to the second partition wall 230 between the second communication path 232 and the third communication path 234. In the depth direction D, an area of the developing roller 240 over which the developer G is delivered is disposed between the second communication path 232 and the third communication path 234. Herein, the second partition wall 230 is an example of a second partition wall, and the second communication path 232 is an example of a second communication path.

Ceiling Portion

As shown in FIGS. 3 to 6, the ceiling portion 218 is formed in the replenish path 212 in the housing 210, at a portion corresponding to the first communication path 222, so as to extend from the upstream side in the rotation direction R1 of the replenish auger 250 (described below) to the vicinity of the discharge plates 258 (described below) on the replenish auger 250. The ceiling portion 218 covers at least the upper part of the replenish auger 250.

More specifically, as shown in FIG. 6, the base end of the ceiling portion 218 is located in an area of angle θ1 with respect to the normal to the axis of the rotary shaft 252 of the replenish auger 250 toward the upstream side in the rotation direction R1 of the replenish auger 250. The angle θ1 is from 40° to 60°, and more preferably, from 45° to 50°. In this exemplary embodiment the angle θ1 is 45°.

The terminal end of the ceiling portion 218 is located in an area of angle θ2 with respect to the normal toward the upstream side in the rotation direction R1 of the replenish auger 250. The angle θ2 is from 0° to 35°, and more preferably, from 15° to 30°. In this exemplary embodiment, the angle θ2 is 25°.

The ceiling portion 218 only needs to have a portion inclined upward from the replenish auger 250 side toward the supply auger 260 side. Hence, the ceiling portion 218 does not need to be curved in an arc and may be linearly inclined upward from a portion upstream of the top of the replenish auger 250 in the rotation direction R1. The ceiling portion 218 may include an arc-shaped portion and a linear portion.

The ceiling portion 218 has a function of discharging the developer G supplied by the discharge plates 258 (described below) into the supply path 214 so as to dump the developer G from above the rotary shaft 252 of the replenish auger 250. Herein, the ceiling portion 218 is an example of a guide part.

Replenish Auger

The replenish auger 250 is disposed in the replenish path 212 extending in the depth direction D of the housing 210. The replenish auger 250 includes the rotary shaft 252, the spiral blade 254 projecting from the outer circumferential surface of the rotary shaft 252, the reverse spiral blade 256, and the discharge plates 258 provided between the spiral blade 254 and the reverse spiral blade 256. The replenish auger 250 is connected to a driving unit (not shown) and is rotated in the arrow R1 direction in FIG. 3. Herein, the replenish auger 250 is an example of a first transport member.

The spiral blade 254 projects so as to be capable of transporting the developer G in the arrow G1 direction in FIG. 2 and is formed from the far side in the depth direction D to a position facing the first communication path 222 in the first partition wall 220. The reverse spiral blade 256 is formed so as to face a portion of the first partition wall 220 located downstream of the first communication path 222, on the downstream side in the developer transport direction G1, in which the developer G is transported by the replenish auger 250.

In this exemplary embodiment, as shown in FIGS. 2 and 3, the discharge plates 258 extend in directions tangent to the outer circumferential surface of the rotary shaft 252 in the longitudinal direction, at positions shifted from each other by 180 degrees, so as to extend in the same direction, as two plate-shaped members projecting in directions opposite to the rotation direction of the rotary shaft 252. The ends of the discharge plates 258 in the direction parallel to the rotary shaft 252 are connected to the spiral blade 254 and the reverse spiral blade 256, and the projection height of the discharge plates 258 is equal to the projection height of the spiral blade 254 at the ends. Herein, the discharge plates 258 are an example of a first blade member.

The discharge plates 258 on the replenish auger 250 have a function of supplying the developer G, which has been supplied from the developer replenishing unit (not shown) to the replenish path 212, to the supply path 214 so as to discharge the developer G from above the rotary shaft 252. In this exemplary embodiment, the discharge plates 258 on the replenish auger 250 disposed in the replenish path 212 discharge the developer G toward the supply path 214, which is located above the replenish path 212, from above the rotary shaft. Herein, the bottom of the supply path 214 is located above the bottom of the replenish path 212 and overlaps the replenish path 212 (i.e., the space in which the replenish auger 250 is disposed) in the top-bottom direction.

Supply Auger

In the housing 210, the supply auger 260 is disposed in the supply path 214 adjoining the replenish path 212. The supply auger 260 includes the rotary shaft 262, the spiral blade 264 projecting from the outer circumferential surface of the rotary shaft 262, the reverse spiral blade 266, the blocking spiral blade 267, and the delivery plate 268 provided between the spiral blade 264 and the reverse spiral blade 266. The supply auger 260 is connected to a driving unit (not shown) and is rotated in the arrow R2 direction in FIG. 3. The rotary shaft 262 of the supply auger 260 has a larger diameter than the rotary shaft 252 of the replenish auger 250 and the rotary shaft 272 of the stirring auger 270. Herein, the supply auger 260 is an example of a second transport member, and the blocking spiral blade 267 is an example of a blocking blade.

The spiral blade 264 projects so as to be capable of transporting the developer G in the arrow G2 direction in FIG. 2 and is formed from the far side in the depth direction D to a position in front of the first communication path 222 in the first partition wall 220. The blocking spiral blade 267 and the reverse spiral blade 266 are formed on the upstream side and on the downstream side of the first communication path 222, on the downstream side in the developer transport direction G2, in which the spiral blade 264 transports the developer. In other words, the blocking spiral blade 267 is provided on the upstream side of the upstream end of the delivery plate 268 in the developer transport direction in the supply path 214.

The delivery plate 268 is provided at a position facing the first communication path 222 and between the blocking spiral blade 267 and the reverse spiral blade 266, which are provided on the upstream side and on the downstream side. In this exemplary embodiment, as shown in FIGS. 2 and 3, the delivery plate 268 is formed as a single plate-like member projecting in the radial direction from the outer circumferential surface of the rotary shaft 262 in the longitudinal direction. The ends of the delivery plate 268 in the direction in which the rotary shaft 262 extends are connected to the blocking spiral blade 267 and the reverse spiral blade 266, and the projection height of the delivery plate 268 is equal to the projection height of the reverse spiral blade 266 at the ends. Herein, the delivery plate 268 is an example of a second blade member.

The supply auger 260 has a function of supplying the developer G to the image carrier 21 and circulating, while stirring, the developer G between the supply path 214 and the stirring path 216.

Stirring Auger

The stirring auger 270 is disposed adjacent to the supply path 214, on the side opposite from the replenish path 212, in the housing 210. The stirring auger 270 includes the rotary shaft 272, the spiral blade 274 projecting from the outer circumferential surface of the rotary shaft 272, and the reverse spiral blade 276. The stirring auger 270 is connected to a driving unit (not shown) and is rotated in the arrow R2 direction in FIG. 3. Herein, the stirring auger 270 is an example of a third transport member.

The spiral blade 274 projects so as to be capable of transporting the developer G in the arrow G3 direction in FIG. 2 and is formed from the near side in the depth direction D to a position facing the third communication path 234 in the second partition wall 230. The reverse spiral blade 276 is continuous with the spiral blade 274 at the downstream end of the spiral blade 274 in the developer transport direction G3 and is formed from a position facing the third communication path 234 toward the downstream side of the stirring path 216.

An upstream portion of the spiral blade 274 in the developer transport direction G3 faces the second communication path 232 in the second partition wall 230.

The stirring auger 270 has a function of stirring and mixing the developer G circulated from the supply path 214 with the developer G supplied from the replenish path 212. The stirring auger 270 also has a function of transporting the mixed developer G to the supply path 214 for circulation.

Operation of Relevant Part

The operations of the relevant parts will be described with reference to FIGS. 2 to 4. In the description below, the replenish path 212, the supply path 214, and the stirring path 216 in the developing device 24 accommodate the developer G.

In the developing device 24, the developer G is circulated between the supply path 214 and the stirring path 216. When the developer G has decreased due to consumption, new developer G is supplied to the supply path 214 and the stirring path 216 from the replenish path 212.

Replenish Path and Supply Path

In the replenish path 212, the developer G supplied from the developer replenishing unit (not shown) is transported by the replenish auger 250 in the arrow G1 direction and is supplied to the supply path 214 and the stirring path 216.

The developer G in the replenish path 212 is discharged and supplied into the supply path 214 so as to be dumped from above the rotary shaft 252 of the replenish auger 250 through the first communication path 222 by the rotation of the discharge plates 258 in the arrow R1 direction and the guidance by the ceiling portion 218.

In other words, the developer G is discharged and supplied so as to fall on the developer G that has been transported to the position of the first communication path 222 through the supply path 214 by the supply auger 260 in the arrow G2 direction.

Furthermore, the developer G in the supply path 214 is transported in the arrow G2 direction from the upstream side of the supply path 214 by the rotation of the supply auger 260 in the arrow R2 direction. A portion of the transported developer G is supplied to the image carrier 21 via the scoop roller 280 disposed above the supply auger 260 in the height direction H and the developing roller 240 disposed between the scoop roller 280 and the image carrier 21. Herein, the rotary shaft 262 of the supply auger 260 has a larger diameter than the rotary shaft 252 of the replenish auger 250 and the rotary shaft 272 of the stirring auger 270. Because the projection height of the spiral blade 264 provided on the supply auger 260 from the rotary shaft 262 is small, the amount of the developer G transported by the supply auger 260 is smaller than the amount of the developer G transported by the replenish auger 250 and the amount of the developer G transported by the stirring auger 270. This suppresses variation in the amount of the developer G supplied from the supply auger 260 to the scoop roller 280.

Furthermore, the replenish path 212 is located below the supply path 214 in the height direction H. More specifically, the bottom of the supply path 214 is located above the bottom of the replenish path 212 in the direction of gravitational force.

The bottom of the supply path 214 is located above the bottom of the replenish path 212 in the area overlapping the replenish path 212. In this exemplary embodiment, the upper part of the spiral blade 254 of the replenish auger 250 overlaps the rotary shaft 262 of the supply auger 260 in the direction of gravitational force.

In this state, the developer G in the replenish path 212 is supplied, so as to be dumped, onto the supply auger 260 through the first communication path 222 by the rotation of the discharge plates 258 on the replenish auger 250 in the arrow R1 direction.

This configuration suppresses compaction of the developer G, compared with a configuration in which only a reverse spiral blade is provided so as to face the first communication path 222, through which the developer G is supplied (replenished) to the supply path 214 adjoining the replenish path 212.

Supply Path, Stirring Path, and Replenish Path

The developer G that has not been supplied to the scoop roller 280 is transported to the downstream side of the supply path 214 by the rotation of the supply auger 260. A portion of the transported developer G is blocked by the blocking spiral blade 267 formed on the upstream side of the delivery plate 268 in the transport direction and moves to the stirring path 216 through the second communication path 232. The developer G that has moved to the stirring path 216 is transported through the stirring path 216 in the arrow G3 direction by the rotation of the stirring auger 270 in the arrow R2 direction.

The developer G in the supply path 214 that has not been directly moved to the second communication path 232 is transported to the position of the delivery plate 268 provided so as to face the second communication path 232. The transported developer G is blocked by the reverse spiral blade 266 formed on the downstream side of the delivery plate 268 in the transport direction and moves to the stirring path 216 through the second communication path 232. At this time, the developer G is scooped up by the rotation of the delivery plate 268 in the arrow R2 direction and is supplied onto the developer G transported through the stirring path 216 from above the stirring path 216. The developer G transported through the stirring path 216 in the arrow G3 direction is transported to the supply path 214 through the third communication path 234 while being blocked by the reverse spiral blade 276 provided on the downstream side of the stirring path 216 in the transport direction. In other words, the developer G is transported so as to circulate between the supply path 214 and the stirring path 216 through the second communication path 232 and the third communication path 234.

The developer G in the replenish path 212 supplied so as to be dumped by the rotation of the discharge plates 258 in the arrow R1 direction is also supplied to the second communication path 232 side and thus to the developer G circulating between the supply path 214 and the stirring path 216.

The supply auger 260 includes the blocking spiral blade 267 projecting in the direction opposite to the rotation direction of the spiral blade 264, in the area of the second communication path 232. The blocking spiral blade 267 adjoins the downstream end of the spiral blade 264 of the supply auger 260 in the developer transport direction G2 and transports, while blocking, the developer G to the stirring path 216. The blocking spiral blade 267 is provided at a position facing the second communication path 232 and temporarily blocks a portion of the developer G to circulate the developer G transported through the supply path 214 in the arrow G2 direction to the stirring path 216 through the second communication path 232. Furthermore, the reverse spiral blade 266 that suppresses stagnation of the developer G on the downstream side is provided on the downstream side in the supply path 214 in the developer transport direction G2, on the downstream side of the delivery plate 268. This allows smooth circulation of the developer G from the supply auger 260 to the stirring auger 270.

As described above, the developing device 24 according to this exemplary embodiment includes: the housing 210 having the replenish path 212 through which the developer G is supplied, the supply path 214 adjoining the replenish path 212 with the first partition wall 220 therebetween, and the first communication path 222 communicating with the supply path 214 on the downstream side in the replenish path 212 in the developer transport direction; the replenish auger 250 that is disposed in the replenish path 212 and has the axially rotatable the rotary shaft 252 and the spiral blade 254 projecting from the outer circumferential surface of the rotary shaft 252; the supply auger 260 that is disposed in the supply path 214 and has the axially rotatable rotary shaft 262 and the spiral blade 264 projecting from the outer circumferential surface of the rotary shaft 262; and the discharge plates 258 provided on the replenish auger 250, at a position facing the first communication path 222, the discharge plates 258 extending parallel to the rotary shaft 252, projecting from the outer circumferential surface of the rotary shaft 252, and discharging the developer G onto the supply path 214 from above the rotary shaft 252 in the replenish path 212 with the rotation of the rotary shaft 252.

This configuration suppresses compaction of the developer G, compared with a configuration in which only a reverse spiral blade is provided at a position facing the communication path through which the developer G is supplied to the adjoining transport path.

The housing 210 has the ceiling portion 218 for guiding the developer G to the supply path 214, at a position around the spiral blade 254 in the replenish path 212.

With this configuration, the developer supply direction from the first transport path to the second transport path is stabilized compared with a configuration in which the developer supply direction from the first transport path to the second transport path is determined by the first blade member alone.

The ceiling portion 218 is inclined upward from the replenish auger 250 side toward the supply auger 260 side.

With this configuration, the developer is supplied from above the second transport member, compared with a configuration in which the guide part is a horizontal surface.

Furthermore, the bottom of the supply path 214 is located above the bottom of the replenish path 212 in the area overlapping the replenish path 212 in the direction of gravitational force.

This configuration reduces the width of the housing in the developing device, compared with a configuration in which the first transport path and the second transport path are located at the same level.

Furthermore, the housing 210 has the stirring path 216 adjoining the supply path 214 on the side opposite from the replenish path 212 with the second partition wall 230 therebetween, and the second communication path 232 and the third communication path 234 communicating between the supply path 214 and the stirring path 216 at both ends of the second partition wall 230 in the transport direction (i.e., on both sides in the developer transport direction in the stirring path 216, that is, the arrow G3 direction in FIG. 2). The developing device 24 includes: the stirring auger 270 provided in the stirring path 216 and having the axially rotatable rotary shaft 272 and the spiral blade 274 projecting from the outer circumferential surface of the rotary shaft 272; and the delivery plate 268 provided on the supply auger so as to project from the outer circumferential surface of the rotary shaft 262, at a position facing the second communication path 232, so as to extend along the rotary shaft 262.

With this configuration, compared with a configuration in which only a spiral blade is disposed in the second transport path, at a position facing the other communication path, the developer is delivered from the first transport path and the second transport path to the third transport path, while the compaction of the developer is suppressed.

Furthermore, the supply auger 260 has, within the area of the second communication path 232, the blocking spiral blade 267 that transports, while blocking, the developer G to the stirring path 216, that adjoins the downstream end of the spiral blade 264 in the developer transport direction, and that projects in the direction opposite to the rotation direction of the spiral blade 264.

With this configuration, compared with a configuration in which a blocking spiral blade is provided on the upstream side of a second blade member, the developer is smoothly circulated from the second transport member to the third transport member.

Furthermore, an image forming apparatus according to this exemplary embodiment includes the image carriers 21 that hold developer images, the developing rollers 240 that supply the developer to the image carriers 21, the developing devices 24, and the transfer unit 26 at which the developer images are transferred from the image carriers 21 to a sheet P.

With this configuration, the deterioration of the image formed in the transfer unit 26 is suppressed.

Although a specific exemplary embodiment of the present disclosure has been described in detail above, the present disclosure is not limited to this exemplary embodiment, and it is obvious to those skilled in the art that various exemplary embodiments are possible within the scope of the present disclosure.

For example, although it has been described that the replenish path 212, the supply path 214, and the stirring path 216 are adjoining in this exemplary embodiment, this disclosure of course includes the developing device 24 in which the replenish path 212 is configured as a stirring/transporting path having a stirring function, and the developer G is stirred and circulated between the stirring/transporting path and the supply path 214. Also in such a configuration, the developer G is supplied to the adjoining supply path 214 so as to be dumped therein, thus suppressing compaction of the developer G circulated from the stirring/transporting path, which is provided instead of the replenish path 212, to the supply path 214.

Furthermore, although it has been described that the projection height of the discharge plates 258 is equal to the projection height of the spiral blade 254 in this exemplary embodiment, the projection height of the discharge plates 258 may be either smaller or larger than the projection height of the spiral blade 254. The dimensions may be determined according to the size of the developing device 24, the developer transport capability and the developer transport speed of the replenish path 212, and the like.

Furthermore, although it has been described that two discharge plates 258 are provided on the replenish auger 250 in this exemplary embodiment, the number of the discharge plates 258 may be one, or three or more. The number of the discharge plates 258 may also be determined according to the size of the developing device 24, the developer transport capability and the developer transport speed of the replenish path 212, and the like.

Furthermore, although the discharge plates 258 according to this exemplary embodiment are formed such that the entirety thereof including the root and the end extends parallel to the rotary shaft 252, for example, the entirety of the discharge plates 258 including at least one of the root and the end may be inclined with respect to the rotary shaft 252. In other words, the discharge plates 258 do not necessarily have to have a flat plate shape but may have a twisted or wavy shape.

Furthermore, although it has been described that the projection height of the delivery plate 268 is equal to the projection height of the spiral blade 264 in this exemplary embodiment, the projection height of the delivery plate 268 may be either smaller or larger than the projection height of the spiral blade 264. The dimensions may be determined according to the size of the developing device 24, the developer transport capability and the developer transport speed of the supply path 214 and the stirring path 216, and the like.

Furthermore, although it has been described that one delivery plate 268 is provided on the supply auger 260 in this exemplary embodiment, the number of the delivery plates 268 may be two or more. The number of the delivery plates 268 may also be determined according to the size of the developing device 24, the developer transport capability and the developer transport speed of the replenish path 212, the amount or the circulation speed of the developer G circulating between the supply path 214 and the stirring path 216, and the like.

Furthermore, although the delivery plate 268 is formed such that the entirety thereof including the root and the end extends parallel to the rotary shaft 252 in this exemplary embodiment, for example, the entirety of the delivery plate 268 including at least one of the root and the end may be inclined with respect to the rotary shaft 252. In other words, the delivery plate 268 do not necessarily have to have a flat plate shape but may have a twisted or wavy shape.

Furthermore, although the spiral direction of the blocking spiral blade 267 is opposite to the spiral direction of the spiral blade 264, the spiral direction of the blocking spiral blade 267 does not need to be opposite to the spiral direction of the spiral blade 264 as long as the force for transporting the developer G in the arrow G2 direction is smaller than that of the spiral blade 264. For example, the blocking spiral blade 267 may have the same spiral direction as the spiral blade 264 but a smaller spiral pitch or may have a disc-like shape other than the spiral shape.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a housing having a first transport path through which developer is supplied, a second transport path adjoining the first transport path with a first partition wall therebetween, and a first communication path communicating with the second transport path on a downstream side in a developer transport direction in the first transport path;

a first transport member disposed in the first transport path and having an axially rotatable first rotary shaft and a first spiral blade projecting from an outer circumferential surface of the first rotary shaft;

a second transport member disposed in the second transport path and having an axially rotatable second rotary shaft and a second spiral blade projecting from an outer circumferential surface of the second rotary shaft; and a first blade member projecting from the outer circumferential surface of the first rotary shaft, at a position facing the first communication path, the blade member discharging the developer onto the second transport path from above the first rotary shaft in the first transport path with the rotation of the first rotary shaft, wherein the first transport member and the second transport member overlap in a horizontal direction, and a rotation direction of the first transport member passes between the first transport path and the second transport path from in a direction from top to bottom, and wherein a bottom of the second transport path is located above a bottom of the first transport path in a direction of gravitational force.

2. The developing device according to claim 1, wherein the housing has, at a position around the first blade member, a guide part for guiding the developer to the second transport path.

3. The developing device according to claim 2, wherein the guide part is inclined upward from the first transport member side toward the second transport member side.

4. The developing device according to claim 1, wherein a bottom of the second transport path is located above a bottom of the first transport path in a direction of a gravitational force.

5. The developing device according to claim 1, further comprising:

a third transport member having an axially rotatable third rotary shaft and a third spiral blade projecting from the outer circumferential surface of the third rotary shaft; and a second blade member provided on the second transport member so as to project from the outer circumferential surface of the second rotary shaft, wherein the housing has a third transport path adjoining the second transport path on the side opposite from the first transport path with a second partition wall, therebetween, and a second communication path communicating between the second transport path and the third transport path on the downstream side in the developer transport direction in the second transport path, the third transport member is disposed in the third transport path, and the second blade member is located at a position facing the second communication path.

6. The developing device according to claim 2, further comprising:

a third transport member having an axially rotatable third rotary shaft and a third spiral blade projecting from the outer circumferential surface of the third rotary shaft; and a second blade member provided on the second transport member so as to project from the outer circumferential surface of the second rotary shaft, wherein the housing has a third transport path adjoining the second transport path on the side opposite from the first transport path with a second partition wall, therebetween, and a second communication path communicating between the second transport path and the third transport path on the downstream side in the developer transport direction in the second transport path, the third transport member is disposed in the third transport path, and the second blade member is located at a position facing the second communication path.

7. The developing device according to claim 3, further comprising:

a third transport member having an axially rotatable third rotary shaft and a third spiral blade projecting from the outer circumferential surface of the third rotary shaft; and a second blade member provided on the second transport member so as to project from the outer circumferential surface of the second rotary shaft, wherein the housing has a third transport path adjoining the second transport path on the side opposite from the first transport path with a second partition wall, therebetween, and a second communication path communicating between the second transport path and the third transport path on the downstream side in the developer transport direction in the second transport path, the third transport member is disposed in the third transport path, and the second blade member is located at a position facing the second communication path.

8. The developing device according to claim 4, further comprising:

a third transport member having an axially rotatable third rotary shaft and a third spiral blade projecting from the outer circumferential surface of the third rotary shaft; and a second blade member provided on the second transport member so as to project from the outer circumferential surface of the second rotary shaft, wherein the housing has a third transport path adjoining the second transport path on the side opposite from the first transport path with a second partition wall, therebetween, and a second communication path communicating between the second transport path and the third transport path on the downstream side in the developer transport direction in the second transport path, the third transport member is disposed in the third transport path, and the second blade member is located at a position facing the second communication path.

9. The developing device according to claim 5, wherein the second transport member has, on an upstream side of an upstream end of the second blade member in the developer transport direction in the second transport path, a blocking blade that blocks the developer.

10. The developing device according to claim 6, wherein the second transport member has, on an upstream side of an upstream end of the second blade member in the developer transport direction in the second transport path, a blocking blade that blocks the developer.

11. The developing device according to claim 7, wherein the second transport member has, on an upstream side of an upstream end of the second blade member in the developer transport direction in the second transport path, a blocking blade that blocks the developer.

12. The developing device according to claim 8, wherein the second transport member has, on an upstream side of an upstream end of the second blade member in the developer transport direction in the second transport path, a blocking blade that blocks the developer.

13. An image forming apparatus comprising:

an image carrier that holds a developer image;

a developing roller that supplies developer to the image carrier;

the developing device according to claim 1; and a transfer part where the developer image on the image carrier is transferred to a medium.

* * * * *